US007129852B2

(12) United States Patent
Aslund et al.

(10) Patent No.: US 7,129,852 B2
(45) Date of Patent: Oct. 31, 2006

(54) REMOTE VEHICLE IMMOBILIZATION

(75) Inventors: Bo Aslund, Marstrand (SE); Frank Perry, Brownstown, MI (US); Gurpreet Aulakh, Livonia, MI (US); James W. Helmke, Highland, MI (US); Mark A. Cuddihy, New Boston, MI (US); Ulrika Gillenius, Gothenburg (SE)

(73) Assignee: Ford Motor Company, Dearborn, MI (US)

( * ) Notice: Subject to any disclaimer, the term of this patent is extended or adjusted under 35 U.S.C. 154(b) by 538 days.

(21) Appl. No.: 10/063,767

(22) Filed: May 10, 2002

(65) Prior Publication Data

US 2003/0210129 A1 Nov. 13, 2003

(51) Int. Cl.
*G08C 19/00* (2006.01)

(52) U.S. Cl. ..... 340/825.69; 701/115; 123/335

(58) Field of Classification Search ..... 340/825.72, 340/426, 539, 5.31, 426.11, 426.12, 425.5, 340/825.44, 468, 7.21, 7.39, 7.48, 7.1, 825.69; 70/110, 112; 123/333, 179.2, 335; 180/271; 307/10.1, 10.3, 10.5; 701/36, 115
See application file for complete search history.

(56) References Cited

U.S. PATENT DOCUMENTS 5,769,051 A * 6/1998 Bayron et al. ..... 123/335
5,815,822 A 9/1998 Iu
5,939,975 A 8/1999 Tsuria et al.
5,942,971 A * 8/1999 Fauci et al. ..... 340/442
5,995,898 A * 11/1999 Tuttle ..... 701/102
6,028,537 A * 2/2000 Suman et al. ..... 340/988
6,072,248 A 6/2000 Muise et al.
6,157,317 A * 12/2000 Walker ..... 340/7.1
6,198,996 B1 * 3/2001 Berstis ..... 701/36
6,411,887 B1 * 6/2002 Martens et al. ..... 701/115
6,474,683 B1 * 11/2002 Breed et al. ..... 280/735

* cited by examiner

*Primary Examiner*—Wendy R. Garber
*Assistant Examiner*—Matsuichiro Shimizu
(74) *Attorney, Agent, or Firm*—Jennifer M. Stec; Artz & Artz

(57) ABSTRACT

A vehicle immobilization system (10) is coupled to a network system (20) and includes a vehicle that has a speed sensor (34) generating a vehicle speed signal, a telematics control unit (48) receiving and transmitting signals to and from the network (20), and a speed control module (72). An immobilization controller (30) is coupled to the speed sensor (34), the telematics control unit (48), and the speed control module (72). The immobilization controller (30) receives an immobilization signal from the network (20) and sets a maximum operating speed for the power train controller. When the vehicle speed signal is below the maximum operating speed, the immobilization controller reduces the maximum operating speed within the speed control module until a lower predetermined speed limit is met. The lower speed limit is preferably greater than zero so that some limited mobility of the vehicle may be achieved.

18 Claims, 3 Drawing Sheets

REMOTE VEHICLE IMMOBILIZATION

BACKGROUND OF INVENTION

The present invention relates generally to theft deterrent devices for automotive vehicles, and more specifically, to an engine immobilization system that allows rapid recovery of a vehicle.

Vehicle anti-theft systems typically sound an alarm upon the unauthorized entry into the automotive vehicle. Other anti-theft systems provide engine immobilization using an electronic circuit such as a transponder, which in addition to a cut key allows the engine to be started. Such systems are not effective to reduce carjacking or reduce risks in police pursuit. That is, once a thief obtains the keys for the vehicle the vehicle may be driven away. Also, many systems are capable of being bypassed and thus allow the vehicle to be driven away.

Telematic systems are becoming popular items on motor vehicles. Telematic systems include a network connection to a satellite or cellular phone system that allows directions or the like to be obtained. Such systems typically operate in conjunction with a global positioning system.

In a carjacking situation, it is desirable to let the thief drive away so that the proper authorities may apprehend the suspects. However, once away from the vehicle owner, the proper authorities have no means to restrict the operation of the vehicle.

It would therefore be desirable to provide a system that increases the likelihood of vehicle recovery after a vehicle has been stolen.

SUMMARY OF INVENTION

The present invention provides a system that increases the possibility of recovery using a centralized service provider that operates in connection with police or law enforcement intervention.

In one aspect of the invention, a vehicle immobilization system is coupled to a network system and includes a vehicle that has a speed sensor generating a vehicle speed signal, a telematics control unit receiving and transmitting signals to and from the network, and a speed control module. An immobilization controller is coupled to the speed sensor, the telematics control unit, and the speed control module. The immobilization controller receives an immobilization signal from the network and sets a maximum operating speed for the power train controller. When the vehicle speed signal is below the maximum operating speed, the immobilization controller reduces the maximum operating speed within the speed control module until a lower predetermined speed limit is met. The lower speed limit is preferably greater than zero so that some limited mobility of the vehicle may be achieved.

In a further aspect of the invention a method of operating a vehicle immobilization system comprising:receiving an immobilization signal; setting a maximum operating speed; and when the vehicle speed is below the maximum operating speed, reducing the maximum operating speed to the vehicle speed until the maximum operating speed is a predetermined lower speed limit.

One advantage of the invention is that the system, once the lower speed limit has been reached, allows the vehicle to have limited mobility to prevent, for example, stopping in an undesirable location such as on a railroad track. Also, the system has safeguards to help insure proper use of the system.

Other advantages and features of the present invention will become apparent when viewed in light of the detailed description of the preferred embodiment when taken in conjunction with the attached drawings and appended claims.

DETAILED DESCRIPTION

Figure 1:
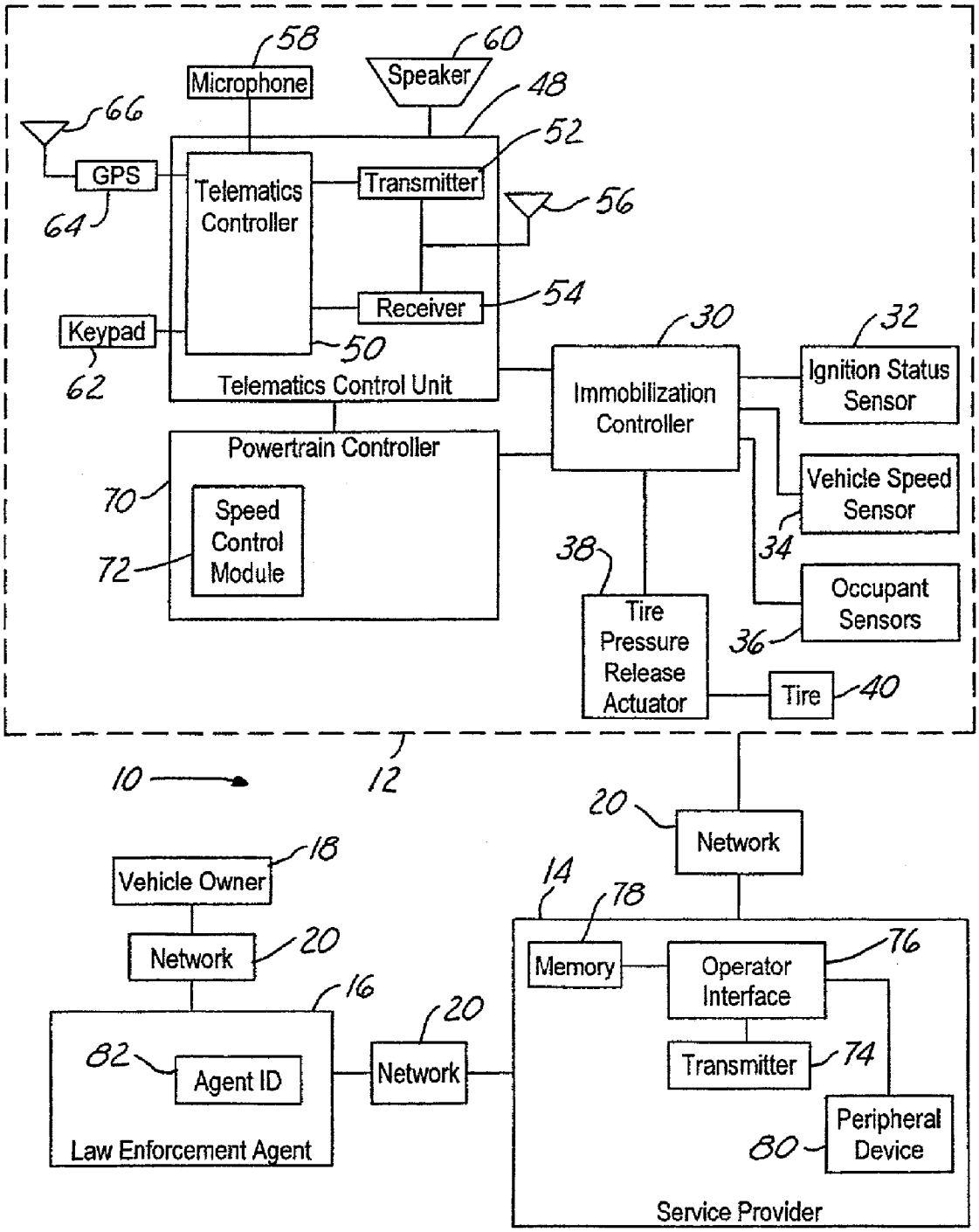
FIG. 1 is a block diagrammatic view of an immobilization system according to the present invention.

In the following figures the same reference numerals will be used to illustrate the same components. While specific components are mentioned in the following description, various alternatives will be evident to those skilled in the art. Such variations are not limited to those set forth below.

Referring now to FIG. 1, an immobilization system 10 is illustrated having a vehicle 12, a service provider 14, a law enforcement agent 16, and a vehicle owner 18. The vehicle owner 18, the law enforcement agent 16, the service provider 14, and the vehicle 12 may be interconnected with a network 20. Network 20 may be various types and combinations of networks including a wireless cellular type connection, a satellite connection, public service telephone network, or private telephone network. The interface between vehicle owner 18 and law enforcement agent 16 may also be personal rather than through network 20.

Vehicle 12 has an immobilization controller 30 that controls the operation of the immobilization system 10 within the vehicle. Immobilization controller 30 is preferably microprocessor based. Although immobilization controller 30 is illustrated as a separate component, the immobilization controller 30 may be incorporated into or combined with various other controllers or control units not limited to those set forth herein.

Immobilization controller 30 is programmed to operate using software to perform the method described below. Immobilization controller 30 is coupled to an ignition status sensor 32 that senses the status of the ignition. Ignition status sensor 32 may for example, be a separate sensor that senses voltage or an ignition switch position sensor. Of course, those skilled in the art will recognize that other types of ignition status sensors may be used.

A vehicle speed sensor 34 is coupled to immobilization controller 30. Vehicle speed sensor 34 may be one of a variety of types of speed sensors typically used in automotive vehicles. For example, a toothed wheel such as that used in anti-lock brake systems may be used. Other types of vehicle speed sensors may also be used including a transmission sensor and obtaining the vehicle speed from a communications bus within the vehicle. Vehicle speed sensor 34 generates a vehicle speed signal.

Occupant sensors 36 are preferably also coupled to immobilization controller 30. Occupant sensors 36 generate an occupant sensor signal indicative of the number of occupants of the vehicle. Occupant sensors 36 may be standalone sensors or may be incorporated into a restraint system of the present invention. Immobilization controller 30 may also be coupled to a tire pressure release actuator 38 that is coupled to one or more vehicle tires 40. Tire pressure release actuator upon a command from immobilization controller 30 may release the tire pressure from tires 40. Immobilization controller 30 is coupled to a telematics control unit 48. Telematics control unit 48 includes a telematics controller 50 that is preferably microprocessor based. Telematics controller 50 is coupled to a transmitter 52 and a receiver 54. Transmitter 52 and receiver 54 receive communication from network 20 through antenna 56. A suitable antenna is used for the type of communications received. For example, antenna 56 may be configured to receive satellite signals, wireless cellular signals or the like.

Telematics controller 50 may also be coupled to a microphone 58 and a speaker 60. Microphone 58 receives voice signals and transmits them to telematics controller 50, which may in turn transmit them through antenna 56. A speaker 60 is also coupled to telematics controller. Speaker 60 broadcasts information within the vehicle, such as those received by receiver 54 through antenna 56. Both microphone 58 and speaker 60 may be stand-alone units or may be incorporated into a hands-free cellular telephone set.

Telematics controller 50 may also be coupled to another input device such as a keypad 62 or other data entry device.

Telematics controller 50 may also be coupled to a global positioning system (GPS) 64. GPS 64 may be coupled to a separate antenna 66 or through antenna 56. GPS 64 generates a position signal of the vehicle and couples that to telematics controller 50.

Immobilization controller 30 is also coupled to a powertrain controller 70. Powertrain controller 70 has a speed control module 72 therein. Powertrain controller 70 may be one of various types of controllers such as an engine controller or a combination engine and transmission controller. Powertrain controller 70 is also preferably microprocessor based. Immobilization controller 30 in conjunction with speed control module 72 may limit the speed of the vehicle to the vehicle speed sensed by vehicle speed sensor 34. The speed control module, as will be further described below, may keep resetting the maximum speed of the vehicle to the vehicle speed as the vehicle speed falls below the maximum vehicle speed. The speed control module will limit the speed up until a lower speed limit such as five miles per hour to allow the vehicle to have a minimum amount of maneuverability.

Service provider 14 includes a transmitter 74 for transmitting various information such as an immobilization signal to vehicle 12. Service provider 14 also includes an operator interface 76. Operator interface 76 may be coupled to a memory 78 and a peripheral device 80. Service provider receives information from law enforcement agent 16 and determines the validity of the signal by a password stored in memory 78. Operator interface 76 may then generate an immobilization signal in response to the law enforcement agent 16.

Law enforcement agent 16 has an agent identification 82 that is transmitted through network 20 to service provider 14. The agent identification 82 may include information transmitted through service provider for verification such as the receiving officer's badge number and the accident report number. Of course, other information such as a law enforcement agent's password may also be required. Law enforcement agent 16 communicates the password from vehicle owner 18 to service provider 14 by way of network 20 which, as mentioned above, may include various means such as public service telephone network, wireless network, or satellite wireless network.

Figure 2:
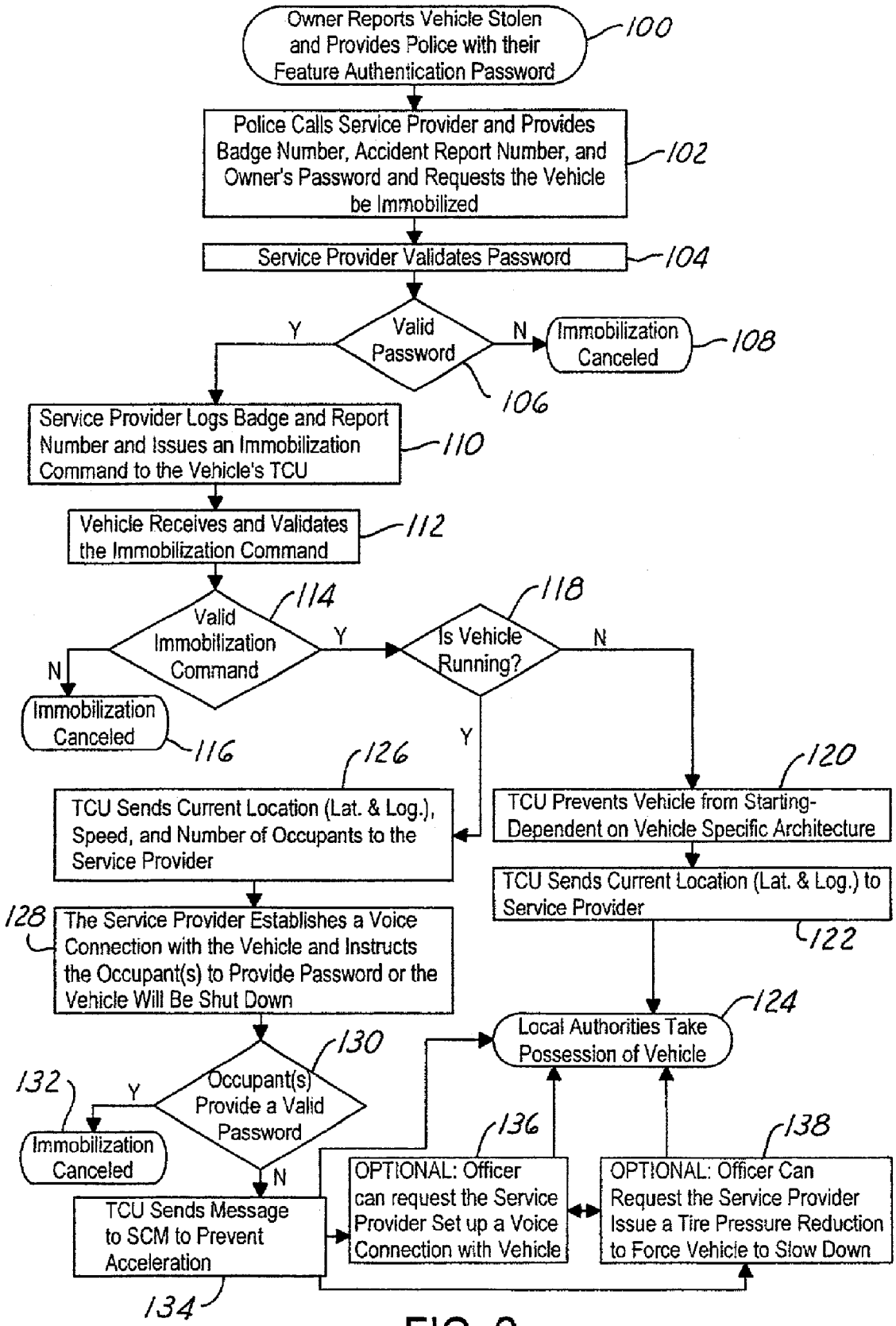
FIG. 2 is a flow chart for immobilizing the vehicle according to the present invention.

Referring now to FIG. 2, a method of immobilizing the vehicle is provided. In step 100 the owner reports the vehicle stolen and provides the police or other law enforcement agent with their password. In step 102 the police or other law enforcement agent provide various agent identifications such as the badge number, accident report, and the vehicle owner's password to request vehicle immobilization. In step 104 the service provider through operator interface 76 validates the password. If the password is not validated in step 106, step 108 cancels the immobilization. In step 106 if the password is valid, the service provider logs the badge number and report number in memory 78 and issues an immobilization signal or command through operator interface 76 through network 20 in step 110. In step 112 the vehicle receives the immobilization command and validates the immobilization command. This is done in the immobilization controller 30 described above through the telematics control unit 48. If the vehicle determines that the immobilization command is not valid in step 114, step 116 cancels the immobilization command. A predetermined code, for example, must be received by vehicle 12 to validate the immobilization command. In step 114 if the immobilization command is valid, step 118 is performed in which it is determined whether or not the vehicle is running. If the vehicle is not running in step 118 the telematics control unit prevents the vehicle from starting in step 120. In step 122, the telematics control unit sends the current location received from GPS 64 to the service provider 14 which may in turn provide the information to a law enforcement agent 16. In step 124, by providing the position of the vehicle the local authorities may take possession of the vehicle that is not able to start.

Referring back to step 118, if the vehicle is running the telematics control unit sends the current location from GPS 64 to service provider 14 which in turn provides the position signal to law enforcement agent 16 through network 20.

In step 128 the service provider may establish a voice connection through telematics control unit and speaker 60 to the current operators of the vehicle. The service provider instructs the current vehicle operator to speak the password, which is received by microphone 58 and transmitted through transmitter 52 to service provider 14. In step 130, if the password is a valid password the immobilization is canceled in step 132. In step 130, if the password is not valid the telematics control unit sends a message to the speed control module 72 through immobilization controller 30 to prevent the vehicle from accelerating. That is, the maximum vehicle speed is set to the current vehicle speed. As the current vehicle speed is reduced, the maximum vehicle speed is also reduced and not allowed to increase. Thus, the maximum vehicle speed is reduced down to a predetermined limit that is greater than zero. This allows the vehicle to still be somewhat maneuvered but at extremely low speed such as five miles per hour. In step 136 the law enforcement agent 16 may also establish a voice connection through service provider 14 to the vehicle operator. Also in step 138 the tire pressure relief actuator 38 may be controlled through immobilization controller 30 at the request of a law enforcement agent if the thief tries to outrun the police officers.

Figure 3:
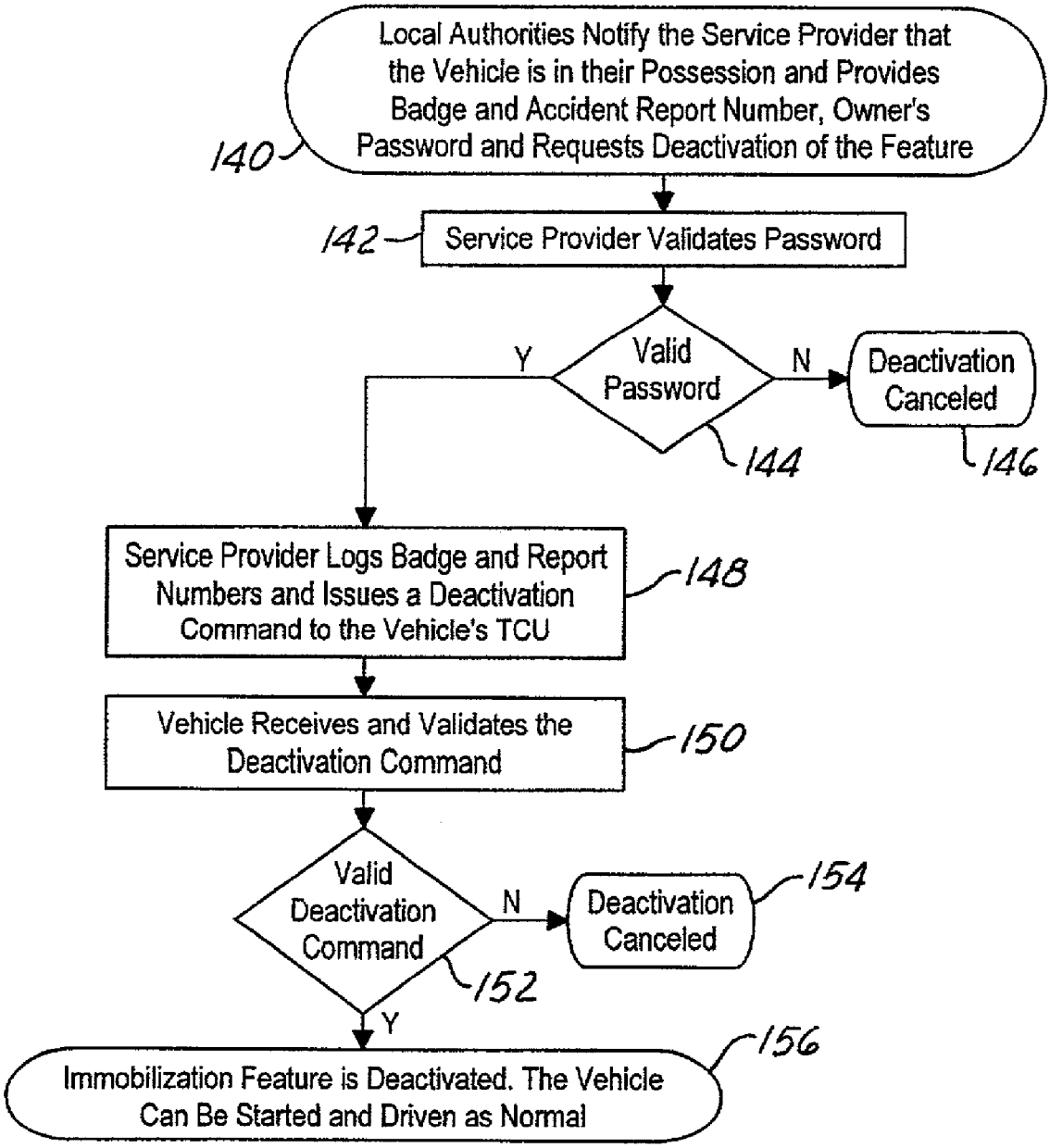
FIG. 3 is a flow chart for deactivating the system according to the present invention.

Referring now to FIG. 3, once the vehicle has been recovered by the law enforcement agent, the law enforcement agent notifies the service provider and provides the agent identification such as the badge number, accident report, the password, and a request for deactivation in step 140. The information coincides with the information of step 102 in FIG. 2. In step 142 the service provider validates the password. If the password is not validated in step 144, step 146 is executed in which deactivation is canceled. In step 144 if the password is a valid password the service provider records the badge number, report number, or other agent identification and sends a deactivation signal to the vehicle 12 in step 148. In step 150, the vehicle receives the deactivation signal through telematics control unit 48 and determines whether the deactivation command is valid in block 152. If the command is not valid in step 152, step 154 is performed in which the deactivation is canceled. In block 152 if the deactivation command is valid, step 156 is executed in which the immobilization is deactivated and the vehicle may be operated normally. The deactivation command may be validated by determining various parameters previously provided from the service provider that is stored within a memory and the immobilization controller or telematics control unit.

As can be seen by the above description, the present invention advantageously allows the vehicle to be driven away from a vehicle operator but, when activated, the vehicle will eventually slow to a very slow speed. This will allow the law enforcement agents to quickly recover the vehicle since vehicle position is provided to the service provider.

While particular embodiments of the invention have been shown and described, numerous variations and alternate embodiments will occur to those skilled in the art. Accordingly, it is intended that the invention be limited only in terms of the appended claims.

The invention claimed is:

1. A vehicle immobilization system coupled to a network system for a vehicle having a powertrain controller comprising:

a speed sensor generating a vehicle speed signal;

a telematics control unit receiving and transmitting signals to and from the network;

a speed control module within the powertrain controller having a maximum operating speed; and an immobilization controller coupled to the speed sensor, the telematics control unit, and the speed control module, said immobilization controller receiving an immobilization signal from the network; setting the maximum operating speed for the vehicle in the speed control module; when the vehicle speed signal is below the maximum operating speed for the vehicle, reducing the maximum operating speed for the vehicle within the speed control module to the vehicle speed, whereby the immobilization controller keeps resetting the maximum operating speed of the speed control module as a function of the vehicle speed falling below the maximum operating speed until the maximum operating speed for the vehicle is a predetermined lower speed limit greater than zero.

2. A system as recited in claim 1 further comprising a global positioning system, said telematics control unit transmitting a position signal to a service provider.

3. A system as recited in claim 1 further comprising a tire pressure release actuator coupled to a plurality of vehicle tires, said controller controlling said release actuator in response to said immobilization signal.

4. A system as recited in claim 1 wherein said immobilization controller is incorporated into said telematics control unit.

5. A system as recited in claim 1 further comprising an occupant sensor coupled to the telematics control unit, said occupant sensor generating an occupant signal indicative of the number of occupants in the vehicle, said telematics control unit transmitting the occupant sensor signal to a service provider.

6. A system as recited in claim 1 further comprising an ignition sensor generating an ignition signal indicative of the engine running and not running, said immobilizer preventing the vehicle from starting when the ignition signal indicates the vehicle is not running.

7. A system as recited in claim 1 wherein said telematics control unit receives an agent identification signal; said immobilization signal being generated in response to said agent identification signal.

8. A system as recited in claim 1 further comprising a powertrain controller, said speed control module positioned within the powertrain controller.

9. A method of operating a vehicle immobilization system comprises:

receiving an immobilization signal;

setting a maximum operating speed; and when the vehicle speed is below the maximum operating speed, continuously resetting the maximum operating speed of the speed control module to the vehicle speed as the vehicle speed falls below the maximum operating speed until the maximum operating speed is a predetermined lower speed limit greater than zero.

10. A method as recited in claim 9 further comprising generating a vehicle position signal, transmitting the vehicle position signal to a service provider.

11. A method as recited in claim 9 when the vehicle is not running, preventing the vehicle from starting.

12. A method as recited in claim 9 when the vehicle is moving, performing the step of reducing the maximum operating speed.

13. A method as recited in claim 9 further comprising disabling the immobilization signal by generating a disabling signal from a service provider in response to an identification signal.

14. A method as recited in claim 9 further comprising generating an occupant number signal; transmitting the occupant number signal to the service provider.

15. A method as recited in claim 9 further comprising releasing air from a vehicle tire in response to the immobilization signal.

16. A method of operating an immobilization system comprising:

contacting a law enforcement agency;

providing a law enforcement agent with a password;

the law enforcement agent contacting a service provider;

the law enforcement agent providing an agent identification and the password;

the service provider generating an immobilization signal to the vehicle;

in the vehicle, receiving the immobilization signal;

setting a maximum operating speed as the current vehicle speed when the vehicle is moving;

when the vehicle speed is below the maximum operating speed, reducing the maximum operating speed to the vehicle speed until the maximum operating speed is a predetermined lower speed limit;

generating an occupant number signal; and transmitting the occupant number signal to the service provider.

17. A method as recited in claim 16 further comprising disabling the immobilization signal.

18. A method as recited in claim 17 wherein disabling comprises the law enforcement agent providing the service provider with the agent identification, the password and a disable request;

validating the password and agent identification;

the service provider transmitting a disable signal to the vehicle.

* * * * *